US009422659B2

(12) United States Patent
Boylston

(10) Patent No.: US 9,422,659 B2
(45) Date of Patent: Aug. 23, 2016

(54) WASHING MACHINE APPLIANCE AND A METHOD OF OPERATING THE SAME

(71) Applicant: General Electric Company, Schenectady, NY (US)

(72) Inventor: Byron Lee Boylston, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 354 days.

(21) Appl. No.: 14/021,138

(22) Filed: Sep. 9, 2013

(65) Prior Publication Data

US 2015/0067969 A1 Mar. 12, 2015

(51) Int. Cl.

| | |
|---|---|
| ***D06F 33/02*** | (2006.01) |
| ***D06F 39/02*** | (2006.01) |
| ***D06F 39/08*** | (2006.01) |

(52) U.S. Cl.

CPC ..... *D06F 39/022* (2013.01); *D06F 33/02* (2013.01); *D06F 39/088* (2013.01); *D06F 2202/02* (2013.01); *D06F 2204/02* (2013.01)

(58) Field of Classification Search

CPC ..... D06F 33/02; D06F 39/022; D06F 39/088; D06F 2202/02; D06F 2204/02

USPC ..... 8/158, 159; 68/12.02, 12.18, 17 R

See application file for complete search history.

(56) References Cited

U.S. PATENT DOCUMENTS

| | | | | |
|---|---|---|---|---|
| 8,286,288 | B2 | 10/2012 | McAllister et al. | |
| 2010/0000023 | A1 | 1/2010 | McAllister et al. | |
| 2012/0017379 | A1 * | 1/2012 | Moore | D06F 35/001 8/137 |
| 2012/0246836 | A1 | 10/2012 | Leibman et al. | |

* cited by examiner

*Primary Examiner* — Michael Barr
*Assistant Examiner* — Levon J Shahinian
(74) *Attorney, Agent, or Firm* — Dority & Manning, P.A.

(57) ABSTRACT

A washing machine appliance and a method for operating a washing machine appliance are provided. The method includes monitoring a flow rate of fluid additive with a flow meter and measuring a volume of fluid additive dispensed after the flow rate of fluid additive substantially decreases. The method can assist with accurately and/or precisely dispensing fluid additive during operating of the washing machine appliance.

19 Claims, 6 Drawing Sheets

WASHING MACHINE APPLIANCE AND A METHOD OF OPERATING THE SAME

FIELD OF THE INVENTION

The present subject matter relates generally to washing machine appliances and methods for operating washing machine appliances.

BACKGROUND OF THE INVENTION

Washing machine appliances can use a variety of fluid additives (in addition to water) to assist with washing and rinsing a load of articles. For example, detergents and/or stain removers may be added during wash and prewash cycles of washing machine appliances. As another example, fabric softeners may be added during rinse cycles of washing machine appliances.

Fluid additives are preferably introduced at an appropriate time during the operation of washing machine appliance and in a proper volume. By way of example, adding laundry detergent and fabric softener simultaneously to liquid water used for a laundry load can negatively affect operation of the washing machine appliance because the two fluid additives can negate each other. Adding insufficient volumes of either the detergent or the fabric softener to the laundry load can also negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

For instance, when too much detergent is added during a wash cycle, detergent can remain in articles after a rinse cycle because the rinse cycle may not be able to remove all of the detergent from the articles. Unremoved detergent can cause graying within such articles as the detergent builds up over time, can contribute to a roughness feeling of such articles, and can trigger skin allergies. The unremoved detergent can also negatively affect the efficacy of fabric softener during the rinse cycle. Further, unremoved detergent can also cause excess suds that can damage the washing machine and/or decrease a spin speed of the washing machine appliance's drum thereby causing articles therein to retain excessive liquids.

As a convenience to the consumer, certain washing machine appliances include systems for automatically dispensing detergent and/or fabric softener. Such systems can store one or more fluid additives in bulk and dispense such fluid additives during operation of the washing machine appliances. However, accurately dispensing a particular volume of fluid additive with such systems can be difficult. For example, hoses or other conduits are typically used to direct fluid additive from a tank to the washing machine appliance's tub. Air within such hoses can negatively affect measurements of fluid additive dispensed by such systems.

Accordingly, a washing machine appliance with features for accurately dispensing a volume of fluid additive would be useful. In particular, a washing machine appliance with features for accurately dispensing a volume of fluid additive despite the presence of air within a dispensing system of the washing machine appliance would be useful.

BRIEF DESCRIPTION OF THE INVENTION

The present subject matter provides a washing machine appliance and a method for operating a washing machine appliance. The method includes monitoring a flow rate of fluid additive with a flow meter and measuring a volume of fluid additive dispensed after the flow rate of fluid additive substantially decreases. The method can assist with accurately and/or precisely dispensing fluid additive during operating of the washing machine appliance. Additional aspects and advantages of the invention will be set forth in part in the following description, or may be apparent from the description, or may be learned through practice of the invention.

In a first exemplary embodiment, a washing machine appliance is provided. The washing machine appliance includes a Venturi pump. An inlet conduit is configured for directing a flow of liquid water to the Venturi pump. A valve is configured for regulating the flow of liquid water in the inlet conduit. An outlet conduit is configured for directing a flow of wash fluid out of the Venturi pump. The washing machine appliance also includes an additive dispensing system. The additive dispensing system includes a tank that defines a volume. The volume of the tank configured for receipt of a fluid additive. An additive conduit extends between the tank and the Venturi pump. A flow meter is configured for measuring a flow of fluid additive through the additive conduit. A controller is in communication with the valve and the flow meter. The controller is configured for actuating the valve to an open configuration in order to initiate the flow of liquid water to the Venturi pump through the inlet conduit, monitoring a flow rate of fluid flowing through the additive conduit to the Venturi pump with the flow meter after the step of actuating, measuring a volume of fluid additive dispensed at the Venturi pump after the flow rate of fluid flowing through the additive conduit to the Venturi pump decreases by at least a predetermined amount during the step of monitoring, and operating the valve to a closed configuration in order to hinder the flow of liquid water to the Venturi pump through the inlet conduit after a predetermined volume of fluid additive has been dispensed at the Venturi pump.

In a second exemplary embodiment, a method for operating a washing machine appliance is provided. The method includes actuating a valve of the washing machine appliance to an open configuration in order to initiate a flow of liquid through a Venturi pump of the washing machine appliance. The Venturi pump draws fluid additive from a tank of the washing machine appliance into the flow of liquid through the Venturi pump after the step of actuating. The method also includes monitoring a flow rate of fluid additive from the tank to the Venturi pump with a flow meter of the washing machine appliance after the step of actuating, measuring a volume of fluid additive dispensed at the Venturi pump after the flow rate of fluid flowing from the tank to the Venturi pump substantially decreases during the step of monitoring, and operating the valve to a closed configuration in order to hinder the flow of liquid to the Venturi pump after a predetermined volume of fluid additive has been dispensed at the Venturi pump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
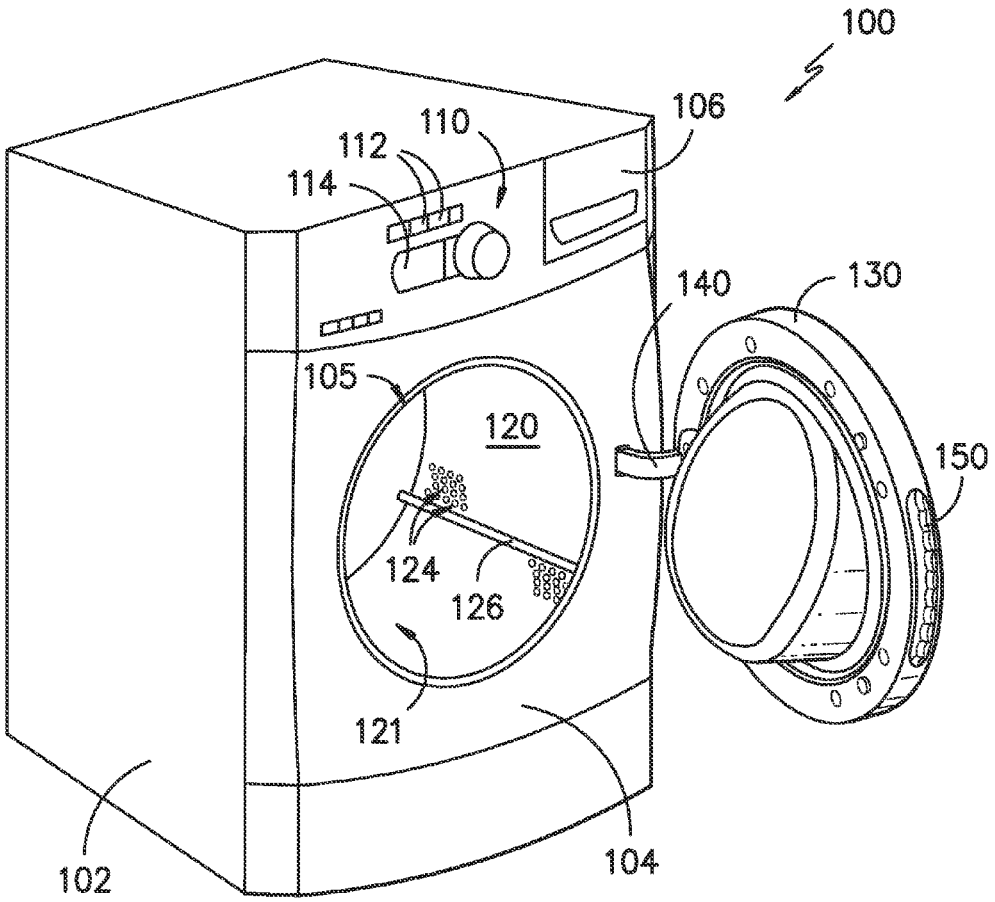
FIG. 1 provides a front, perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of a washing machine appliance 100 according to an exemplary embodiment of the present subject matter. A drum 120 of washing machine appliance 100 is configured for rotating on a substantially horizontal axis. Thus, washing machine appliance 100 is generally referred to as a horizontal axis washing machine appliance. Using the teachings disclosed herein, it will be understood that washing machine appliance 100 is provided by way of example only. Other washing machine appliances having different configurations, different appearances, and/or different features may also be utilized with the present subject matter as well. For example, the present subject matter may be used with vertical axis washing machine appliances.

Washing machine appliance 100 has a cabinet 102 with a drum 120 rotatably mounted therein. A motor (not shown) is in mechanical communication with drum 120 in order to selectively rotate drum 120 (e.g., during an agitation or a rinse cycle of washing machine appliance 100). Drum 120 defines a wash chamber 122 that is configured for receipt of articles for washing. Ribs 126 extend from drum 120 into wash chamber 122. Ribs 126 assist agitation of articles disposed within wash chamber 122 during operation of washing machine appliance 100. For example, ribs 126 may lift articles disposed in drum 120 during rotation of drum 120. Drum 120 also defines a plurality of holes 124. Holes 124 are configured to permit a flow of wash fluid between an interior of drum 120 and an exterior of drum 120.

Cabinet 102 of washing machine appliance 100 has a front panel 104. A detergent drawer 106 is slidably mounted within front panel 104. Detergent drawer 106 receives detergent and directs said detergent to wash chamber 122 during operation of appliance 100. As discussed in greater detail below, washing machine appliance 100 also includes features for bulk dispensing of detergent and/or other fluid additives. Thus, a user need not utilize detergent drawer 106 during each operation of washing machine appliance 100.

Front panel 104 defines an opening 105 that permits user access to wash chamber 122 of drum 120. A door 130 is mounted to front panel 104 with a hinge 140. Door 130 provides selective access to wash chamber 122. A user may selectively adjust door 130 between a closed positioned (not shown) and an open position (shown in FIG. 1) in which the user may access wash chamber 122 of drum 120. A user may adjust door 130 between the open and closed configurations by rotating door 130 about hinge 140. For example, to open door 130 from closed configuration, the user may pull on a handle 150 in order to rotate door 130 open.

Front panel 104 also includes a control panel 110 with a plurality of input selectors 112. Control panel 110 and input selectors 112 collectively form a user interface input for operator selection of machine cycles and features. A display 114 of control panel 110 indicates selected features, a countdown timer, and/or other items of interest to appliance users.

FIGS. 2, 3, 4 and 5 provide schematic views of certain components of washing machine appliance 100 with a fluid additive dispensing system 180 of washing machine appliance 100 shown in various operation states. As may be seen in FIGS. 2-5, washing machine appliance 100 includes a Venturi pump 170, an inlet conduit 172, an outlet conduit 174, and a nozzle 176. Inlet conduit 172 extends between a water supply 190 and Venturi pump 170. In particular, inlet conduit 172 extends between an entrance 192 and an exit 194. Entrance 192 of inlet conduit 172 is positioned at water supply 190 is configured for receipt of liquid water from water supply 190. Conversely, exit 194 of inlet conduit 172 is positioned at or mounted to Venturi pump 170 and is configured for directing liquid water from water supply 190 into Venturi pump 170. Inlet conduit 172 can include any suitable mechanism for containing and directing a flow of liquid water therethrough. For example, inlet conduit 172 may include piping, hoses, tubing, combinations thereof, etc.

Water supply 190 can be any suitable source of liquid water. For example, water supply 190 may be a municipal water supply or a well. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

As discussed in greater detail below, when liquid, such as liquid water from water supply 190, flows though Venturi pump 170, Venturi pump 170 draws or urges a fluid additive from fluid additive dispensing system 180 into the liquid flowing though Venturi pump 170 in order to form a wash fluid therein. Such wash fluid is directed out of Venturi pump 170 into outlet conduit 174.

Outlet conduit 174 extends between Venturi pump 170 and nozzle 176. In particular, outlet conduit 174 extends between an entrance 196 and an exit 198. Entrance 196 of outlet conduit 174 is positioned at or mounted to Venturi pump 170 and is configured for receipt of wash fluid from Venturi pump 170. Conversely, exit 198 of outlet conduit 174 is positioned at or mounted to nozzle 176 and is configured for directing wash fluid from Venturi pump 170 into nozzle 176. Outlet conduit 174 can include any suitable mechanism for containing and directing a flow of liquid water therethrough. For example, outlet conduit 174 may include piping, hoses, tubing, combinations thereof, etc.

Nozzle 176 is positioned adjacent drum 120 (FIG. 1) and is configured for directing fluid additive from outlet conduit 174 into wash chamber 122 of drum 120. For example, drum 120 is rotatably mounted within a tub (not shown) of washing machine appliance 100. The tub is configured for receiving and containing wash fluid during operating of washing machine appliance 100. Nozzle 176 may be mounted to the tub and positioned above drum 120 such that wash fluid from nozzle 176 falls downwardly towards articles within wash chamber 122 of drum 120.

As may be seen in FIGS. 2-5, fluid additive dispensing system 180 includes a tank 182 and an additive conduit 184. Tank 182 defines a volume 183 for receiving and containing fluid additive therein. Volume 183 can contain any suitable amount of fluid additive. For example, tank 182 may be sized such that volume 183 contains sufficient fluid additive for numerous wash cycles of washing machine appliance 100. In particular, tank 182 may be sized such that volume 183 contains sufficient fluid additive for about or at least ten, twenty, thirty, fifty or one hundred wash cycles of washing machine appliance 100. Tank 182 can contain any suitable fluid additive. For example, the fluid additive may include detergent, fabric softener, bleach, etc.

Additive conduit 184 extends between tank 182 and Venturi pump 170. In particular, additive conduit 184 extends between an entrance 186 and an exit 188. Entrance 186 of additive conduit 184 is positioned at or mounted to tank 182 and is configured for receipt of fluid additive from volume 183 of tank 182. Conversely, exit 188 of additive conduit 184 is positioned at or mounted to Venturi pump 170 and is configured for directing fluid additive within additive conduit 184 into Venturi pump 170. In certain exemplary embodiments, entrance 186 of additive conduit 184 is positioned below exit 188 of additive conduit 184, e.g., along a vertical direction V. In such a manner, gravity can assist with limiting undesired or additional dispensing of fluid additive from fluid additive dispensing system 180 at Venturi pump 170, e.g., after a flow of liquid from water supply 190 through Venturi pump 170 is terminated or limited. Additive conduit 184 can include any suitable mechanism for containing and directing a flow of liquid water therethrough. For example, additive conduit 184 may include piping, hoses, tubing, combinations thereof, etc.

Washing machine appliance 100 also includes a flow meter 162 and a valve 164. Flow meter 162 may be positioned adjacent or mounted to additive conduit 184. Flow meter 162 is configured for measuring a flow of fluid through additive conduit 184. In particular, flow meter 162 may measure a flow rate of the flow of fluid additive through additive conduit 184. Flow meter 162 can be any suitable mechanism for measuring fluid flow through additive conduit 184. For example, flow meter 162 may be a mechanical flow meter, a pressure-based flow meter, an optical flow meter, an electrical flow meter, etc. In certain exemplary embodiments, flow meter 162 may be a bidirectional flow meter such that flow meter 162 can measure the flow rate of the flow of fluid additive through additive conduit 184 regardless of the direction of fluid flow through additive conduit 184.

Valve 164 is positioned adjacent or mounted to inlet conduit 172. Valve 164 is configured for regulating the flow of liquid within inlet conduit 172. In particular, valve 164 is selectively adjustable between an open configuration and a closed configuration. In the open configuration, valve 164 permits fluid flow through inlet conduit 172, e.g., such that liquid water from water supply 190 may flow through inlet conduit 172 to Venturi pump 170. Conversely, valve 164 obstructs or prevents fluid flow through inlet conduit 172, e.g., such that liquid water from water supply 190 may not flow through inlet conduit 172 to Venturi pump 170, in the closed configuration. Valve 164 may be any suitable mechanism for regulating or adjusting fluid flow through inlet conduit 172. For example, valve 164 may be a solenoid valve.

As may be seen in FIGS. 2-5, washing machine appliance 100 also includes a processing device or controller 160. Operation of washing machine appliance 100 is regulated or controlled by controller 160. Controller 160 includes memory and one or more processing devices such as microprocessors, CPUs or the like, such as general or special purpose microprocessors operable to execute programming instructions or micro-control code associated with operation of washing machine appliance 100. The memory can represent random access memory such as DRAM, erasable read/write-once memory such as FLASH, or read only memory such as ROM. The memory can be a separate component from the processor or can be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 is operatively coupled to various components of washing machine appliance 100. For example, controller 160 is in communication with control panel 110 in order to permit user manipulation of input selectors 112 to select washing machine appliance cycles and features. Thus, in response to user manipulation of control panel 110, controller 160 operates the various components of washing machine appliance 100 to execute selected machine cycles and features. Controller 160 is also in communication with flow meter 162 and valve 164. Based at least in part on signals from flow meter 162, controller 160 can measure the flow rate of fluid additive within additive conduit 184. For example, voltage or current supplied by flow meter 162 can correspond to the flow rate of fluid additive within additive conduit 184.

Washing machine appliance 100 also includes features for assisting with accurate and/or precise dispensing of fluid additive from fluid additive dispensing system 180. In particular, washing machine appliance 100 includes features for assisting with accurately and/or precisely dispensing a particular volume of fluid additive with fluid additive dispensing system 180. Such features can assist with operation of washing machine appliance 100 by facilitating dispensing of a proper volume of fluid additive. Such features can also assist with avoiding waste of fluid additive during operation of washing machine appliance 100.

Figure 5:
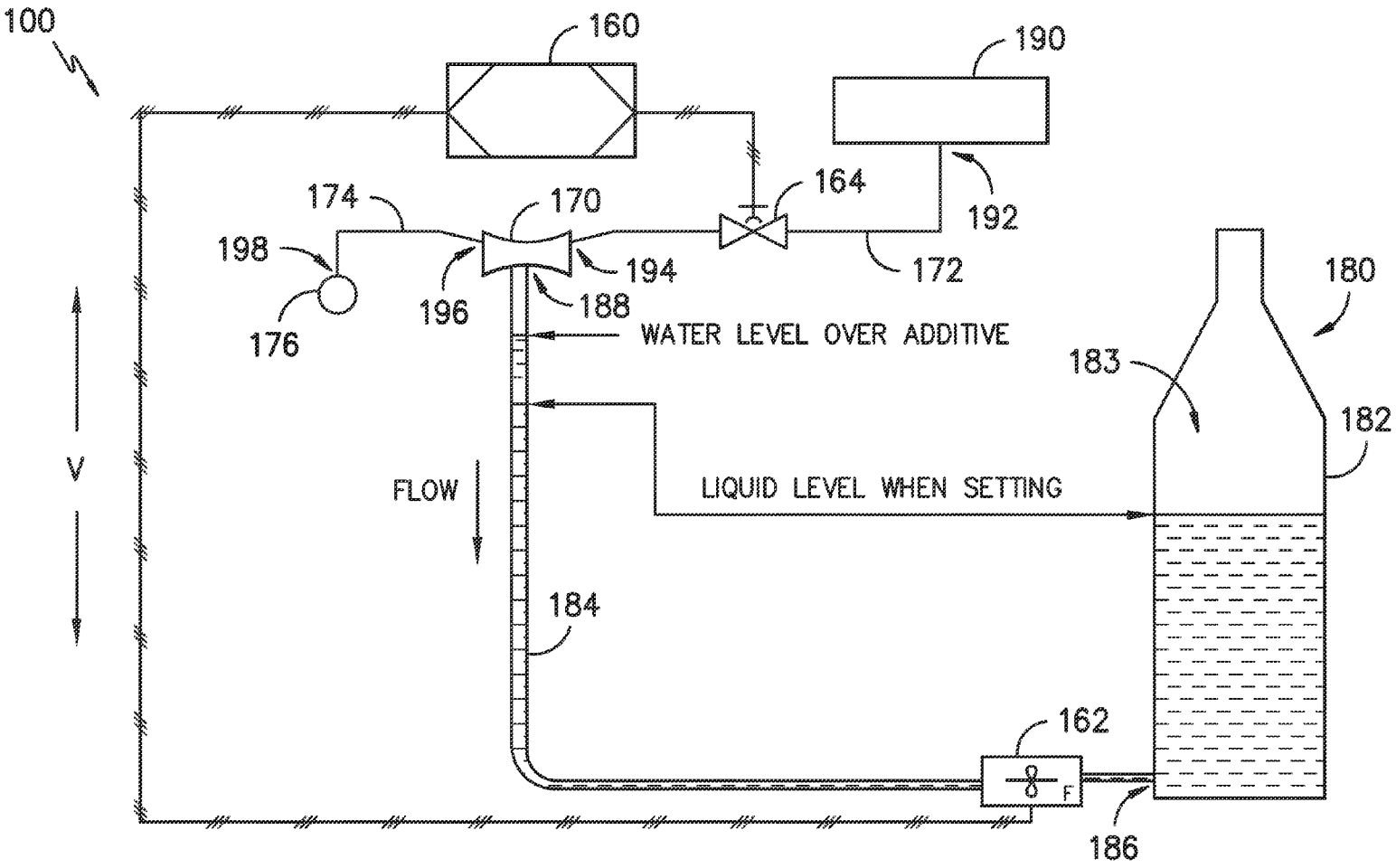
Figure 6:
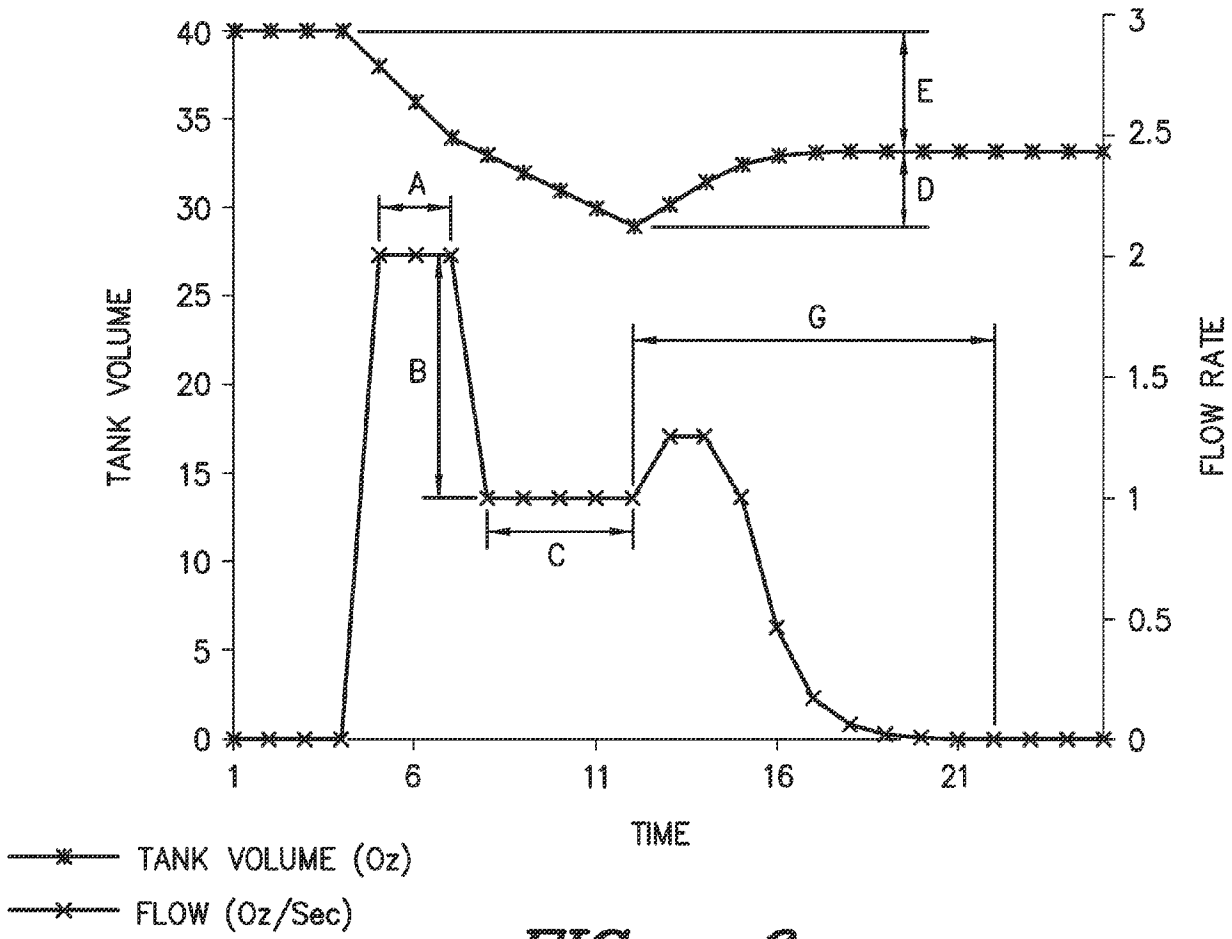
FIG. 6 provides exemplary plots of a volume of fluid additive within a tank of a fluid additive dispensing system and a flow rate of fluid through an additive conduit of the fluid additive dispensing system versus time.

FIG. 6 provides exemplary plots of a volume of fluid additive within tank 182 of fluid additive dispensing system 180 and a flow rate of fluid through additive conduit 184 of fluid additive dispensing system 180 versus time during an operation of washing machine appliance 100 and fluid additive dispensing system 180. Operation of washing machine appliance 100 and features of washing machine appliance 100 that assist with accurately and/or precisely dispensing a proper volume of fluid additive with fluid additive dispensing system 180 are discussed in greater detail below with reference to FIGS. 2, 3, 4, 5 and 6. As an example of an operation of washing machine appliance 100, a user can load articles for washing into wash chamber 122 of drum 120, and the user can initiate washing operation through manipulation of input selectors 112 of control panel 110. Fluid additive from fluid additive dispensing system 180 can assist with washing the articles within wash chamber 122 of drum 120. However, fluid additive dispensing system 180 can require priming prior to dispensing fluid additive.

Figure 2:
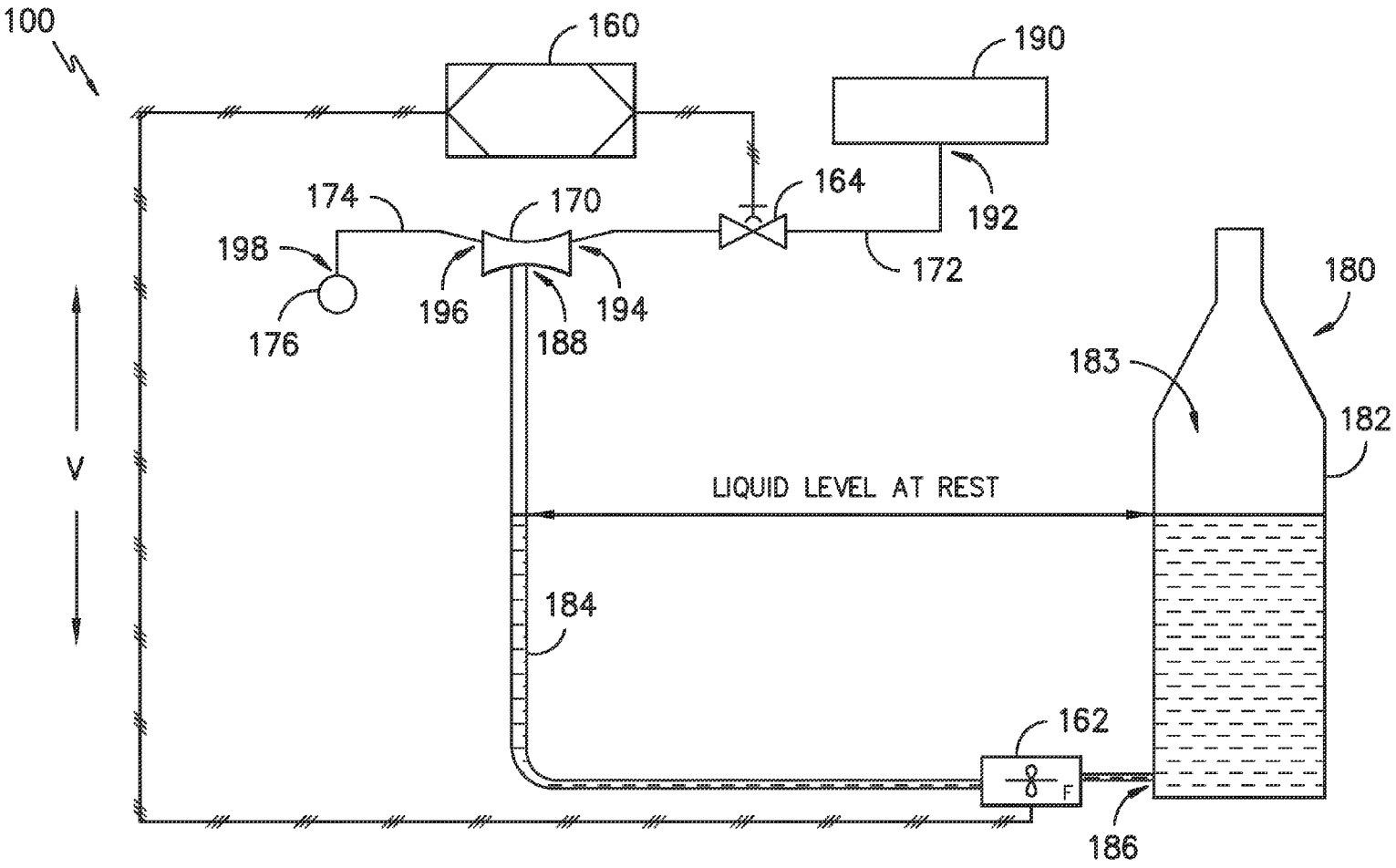
FIGS. 2, 3, 4 and 5 provide schematic views of certain components of the exemplary washing machine appliance of FIG. 1 with a fluid additive dispensing system of the exemplary washing machine appliance shown in various operation states.

In FIG. 2, fluid additive dispensing system 180 is shown in a resting operation state. In the resting operation state, valve 164 is in the closed configuration such that liquid water from water supply 190 is hindered from flowing through inlet conduit 172 to Venturi pump 170. Because liquid is not flowing through Venturi pump 170, Venturi pump 170 does not draw fluid additive from tank 182 when fluid additive dispensing system 180 in the resting operating state. As may be seen in FIG. 2, a height of fluid additive in additive conduit 184 is equal to a height of fluid additive in tank 182, e.g., due to Venturi pump 170 not drawing fluid additive out of tank 182 via additive conduit 184. Also, additive conduit 184 contains air above the fluid additive therein. Thus, Venturi pump 170 is unprimed when fluid additive dispensing system 180 is in the resting operation state, and fluid additive dispensing system 180 does not dispense fluid additive from tank 182 into liquid water flowing through Venturi pump 170.

Turning to FIG. 6, the exemplary operation of fluid additive dispensing system 180 occurs over a time interval of about twenty five seconds or less. Certain portions of the time interval are labeled A, C, F and G. Such portions of the time interval are discussed in greater detail below with the respect to the corresponding condition of fluid additive dispensing system 180. In FIG. 6, fluid additive dispensing system 180 is in the resting operation state (shown in FIG. 2) during the portion of the time interval before the portion A of the time interval and after the portion G of the time interval. As may be seen in FIG. 6, the flow rate of fluid, such as fluid additive from tank 182, within additive conduit 184 is about zero when fluid additive dispensing system 180 is in the resting operation state, e.g., because Venturi pump 170 is not drawing fluid additive from tank 182 and the height of fluid additive in additive conduit 184 is about equal to the height of fluid additive in tank 182. Further, the volume of fluid additive within tank 182 is substantially constant when fluid additive dispensing system 180 is in the resting operation state.

Figure 3:
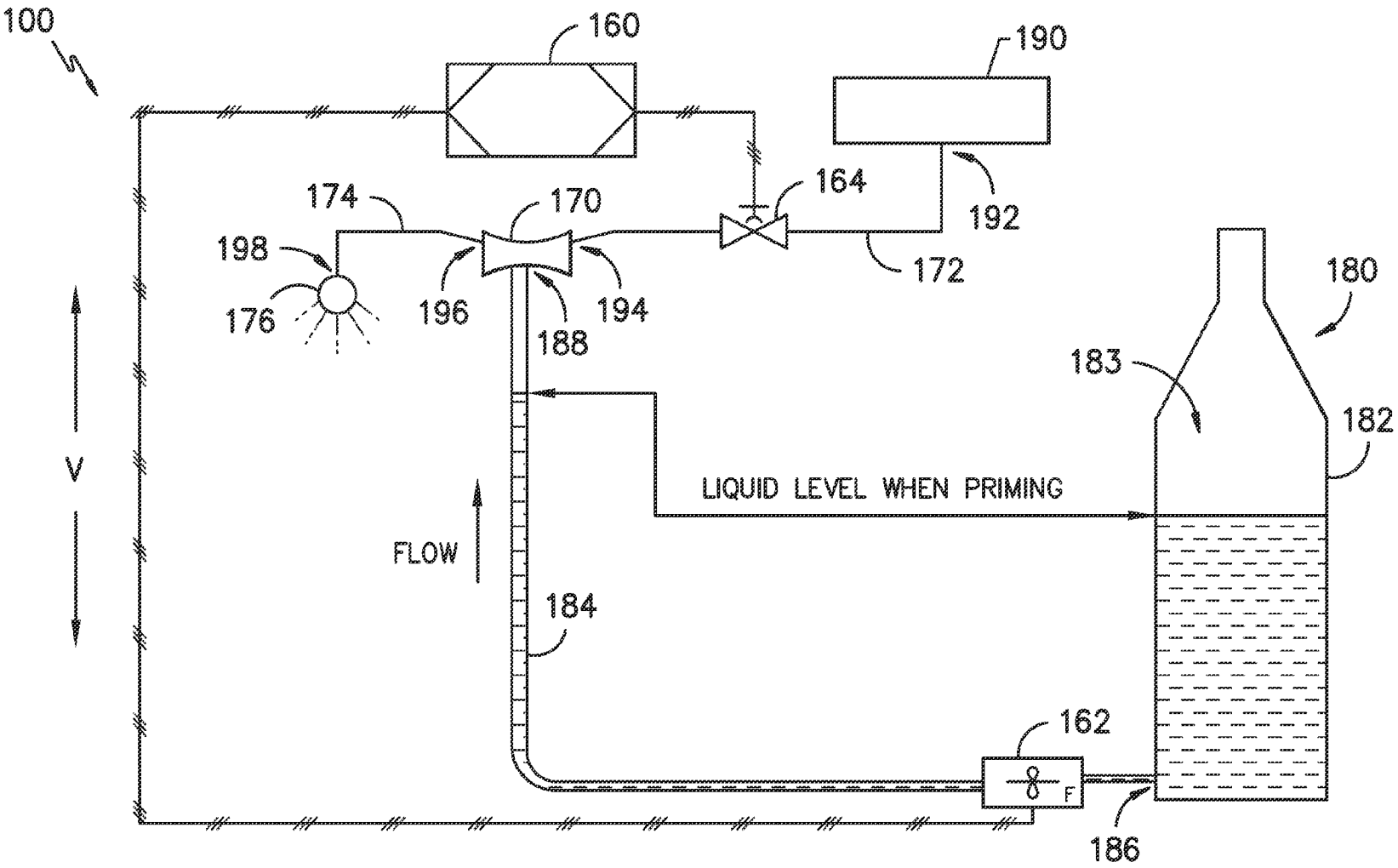

In FIG. 3, fluid additive dispensing system 180 is shown in a priming operation state. In the priming operation state, valve 164 is in the open configuration such that a flow of liquid water from water supply 190 to Venturi pump 170 is initiated. Because liquid is flowing through Venturi pump 170, Venturi pump 170 begins drawing fluid additive from tank 182 when fluid additive dispensing system 180 in the priming operating state. To adjust fluid additive dispensing system 180 from the resting operation state shown in FIG. 2 to the priming operation state shown in FIG. 3, controller 160 can actuate valve 164 from the closed position to the open position.

Controller 160 monitors the flow rate of fluid within additive conduit 184 with flow meter 162 during at least portions A and C of the time interval. In such a manner, controller 160 can determine when Venturi pump 170 primes. As may be seen in FIG. 3, the height of fluid additive in additive conduit 184 is not equal to the height of fluid additive in tank 182, e.g., due to Venturi pump 170 drawing fluid additive out of tank 182 via additive conduit 184. As may be seen in FIGS. 2 and 3, the height of fluid additive in additive conduit 184 in the resting operation state shown in FIG. 2 is less than the height of fluid additive in additive conduit 184 in the priming operation state shown in FIG. 3. Similarly, the height of fluid additive in tank 182 in the resting operation state shown in FIG. 2 is greater than the height of fluid additive in tank 182 in the priming operation state shown in FIG. 3. Additive conduit 184 still contains air above the fluid additive therein in the priming operation state shown in FIG. 3. Thus, Venturi pump 170 remains unprimed when fluid additive dispensing system 180 is in the priming operation state.

In FIG. 6, fluid additive dispensing system 180 is in the priming operation state (shown in FIG. 3) during portion A of the time interval. As may be seen in FIG. 6, the flow rate of fluid, such as fluid additive from tank 182, within additive conduit 184 is about two ounces per second when fluid additive dispensing system 180 is in the priming operation state, e.g., because Venturi pump 170 is drawing air out of additive conduit 184. The flow rate of fluid within additive conduit 184 is substantially constant while fluid additive dispensing system 180 is in the priming operation state.

Figure 4:
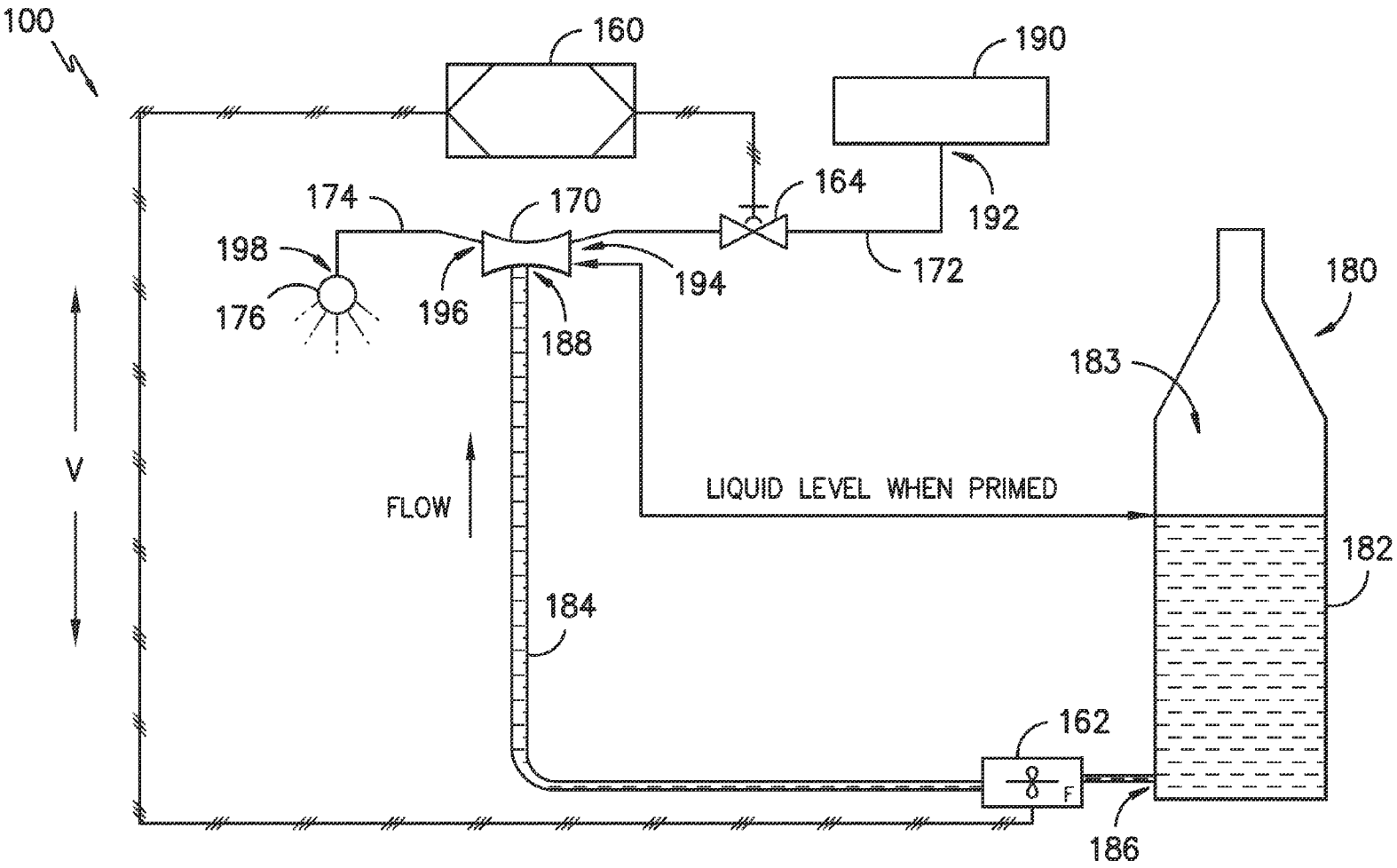

In FIG. 4, fluid additive dispensing system 180 is shown in a primed operation state. In the primed operation state, valve 164 remains in the open configuration such the flow of liquid water from water supply 190 to Venturi pump 170 continues to flow. Because liquid is flowing through Venturi pump 170, Venturi pump 170 draws or urges fluid additive from tank 182 when fluid additive dispensing system 180 in the primed operating state. With fluid additive dispensing system 180 in the primed operation state, wash fluid, e.g., a mix of liquid water from water supply 190 and fluid additive fluid additive dispensing system 180, flows from Venturi pump 170 to nozzle 176.

As may be seen in FIG. 4, the height of fluid additive in additive conduit 184 is not equal to the height of fluid additive in tank 182, e.g., due to Venturi pump 170 drawing fluid additive out of tank 182 via additive conduit 184. As may be seen in FIGS. 3 and 4, the height of fluid additive in additive conduit 184 in the priming operation state shown in FIG. 3 is less than the height of fluid additive in additive conduit 184 in the primed operation state shown in FIG. 4. Similarly, the height of fluid additive in tank 182 in the priming operation state shown in FIG. 3 is greater than the height of fluid additive in tank 182 in the primed operation state shown in FIG. 4. Further, additive conduit 184 does not contain air in the primed operation state shown in FIG. 4. Thus, Venturi pump 170 is primed when fluid additive dispensing system 180 is in the primed operation state such that fluid additive dispensing system 180 dispenses fluid additive from tank 182 into liquid water flowing through Venturi pump 170 in order to form wash fluid within Venturi pump 170. Such wash fluid is directed to nozzle 176 and into wash chamber 122 of drum 120 through outlet conduit 174 from Venturi pump 170.

In FIG. 6, fluid additive dispensing system 180 is in the primed operation state (shown in FIG. 4) during portion C of the time interval. As may be seen in FIG. 6, the flow rate of fluid, such as fluid additive from tank 182, within additive conduit 184 is about one ounce per second when fluid additive dispensing system 180 is in the primed operation state, e.g., because Venturi pump 170 is drawing fluid additive out of additive conduit 184. The flow rate of fluid within additive conduit 184 is substantially constant while fluid additive dispensing system 180 is in the primed operation state. The flow rate of fluid within additive conduit 184 when fluid additive dispensing system 180 is in the primed operation state is less than the flow rate of fluid within additive conduit 184 when fluid additive dispensing system 180 is in the priming operation state, e.g., due to viscosity difference and/or other physical property differences between air and the fluid additive.

Controller 160 measures a volume of fluid additive dispensed at Venturi pump 170 after the flow rate of fluid additive flowing through additive conduit 184 to Venturi pump 170 decreases by a substantial amount or at least a predetermined amount (shown with arrow B) and, e.g., fluid additive dispensing system 180 switches between the in the priming and primed operation states. In such a manner, controller 160 can determine when air within additive conduit 184 is discharged and fluid additive within additive conduit 184 reaches Venturi pump 170. After fluid additive reaches Venturi pump 170, controller 160 monitors the flow rate of fluid within additive conduit 184 in order to determine a volume of fluid additive dispensed at Venturi pump 170. Thus, during portion C of the time interval, controller 160 can utilize the flow rate of fluid through additive conduit 184 from flow meter 162 to calculate the volume of fluid additive dispensed at Venturi pump 170 (shown with arrow E) as will be understood by those skilled in the art.

The predetermined amount can be any suitable value. For example, the predetermined amount may be about five ounces per second, about ten ounces per second, about fifteen ounces per second, about twenty ounces per second, etc. The predetermined value may be selected in order to permit controller 160 to determine when fluid additive dispensing system 180 switches between the priming and primed operation states. Thus, because air flows more easily into Venturi pump 170, the predetermined amount can be selected in order to permit controller 160 to detect when fluid additive within additive conduit 184 reaches Venturi pump 170. As will be understood by those skilled in the art, the predetermined value can vary depending upon the viscosity and other physical properties of the fluid additive within tank 182 and additive conduit 184.

Once drum 120 is properly filled with wash fluid, controller 160 operates or adjusts valve 164 to the closed configuration in order to hinder the flow of liquid water to Venturi pump 170, e.g., after a predetermined volume of fluid additive has been dispensed at Venturi pump 170 from fluid additive dispensing system 180. Articles within wash chamber 122 of drum 120 are agitated with ribs 126 by rotating drum 120. After the agitation phase of the wash cycle is completed, wash fluid is drained from drum 120. Articles can then be rinsed by adding relatively clean fluid to drum 120, depending on the particulars of the cleaning cycle selected by a user, ribs 126 may again provide agitation within wash chamber 122. One or more spin cycles may also be used. In particular, a spin cycle may be applied after the wash cycle and/or after the rinse cycle in order to wring wash fluid from the articles being washed. During a spin cycle, drum 120 is rotated at relatively high speeds.

In FIG. 5, fluid additive dispensing system 180 is shown in a settling operation state. In the settling operation state, valve 164 is in the closed configuration such that liquid water from water supply 190 is hindered from flowing through inlet conduit 172 to Venturi pump 170. Because liquid is not flowing through Venturi pump 170, Venturi pump 170 does not draw fluid additive from tank 182 when fluid additive dispensing system 180 in the settling operating state. Further, the height fluid additive within additive conduit 184 that is above the height of fluid additive in tank 182. Thus, gravity draws or urges fluid additive within additive conduit 184 back into tank 182 until the height fluid additive within additive conduit 184 is about equal to the height of fluid additive in tank 182, e.g., and fluid additive dispensing system 180 is in the resting operation state. In addition, gravity can also draw or urge wash fluid from Venturi pump 170 into additive conduit 184 when fluid additive dispensing system 180 is in the resting operation state.

In FIG. 6, fluid additive dispensing system 180 is in the settling operation state (shown in FIG. 5) during portion G of the time interval. As may be seen in FIG. 6, the flow rate of fluid, such as fluid additive from tank 182, within additive conduit 184 varies and settles to zero when fluid additive dispensing system 180 is in the settling operation state, e.g., as the height fluid additive within additive conduit 184 approaches the height of fluid additive in tank 182. In FIG. 6, flow meter 162 is a bidirectional flow meter, e.g., such that measurements of flow meter 162 are positive despite the direction of flow within additive conduit 184.

Controller 160 can measure the flow rate of fluid additive within additive conduit 184 after valve 164 is closed and fluid additive dispensing system 180 switches from the primed operating state (FIG. 4) to the settling operation state (FIG. 5). Thus, during portion G of the time interval, controller 160 can utilize the flow rate of fluid additive through additive conduit 184 from flow meter 162 to calculate the volume of fluid additive flowing into tank 182 from additive conduit 184 (shown with arrow D). Based upon a volume of fluid additive returning to tank 182 when fluid additive dispensing system 180 is in the settling operation state, controller 160 can determine the height of fluid additive in tank 182 (e.g., if a cross-sectional area of tank 182 is known) and/or the volume of fluid additive in tank 182.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a Venturi pump;
- an inlet conduit configured for directing a flow of liquid water to the Venturi pump;
- a valve configured for regulating the flow of liquid water through the inlet conduit;
- an outlet conduit configured for directing a flow of wash fluid out of the Venturi pump;
- an additive dispensing system comprising
  - a tank defining a volume, the volume of the tank configured for receipt of a liquid additive; and
  - an additive conduit extending between the tank and the Venturi pump;
- a flow meter coupled to the additive conduit and configured for measuring a flow of liquid additive through the additive conduit;
- a controller in communication with the valve and the flow meter, the controller configured for
  - actuating the valve to an open configuration in order to initiate the flow of liquid water to the Venturi pump through the inlet conduit;
  - monitoring a flow rate of liquid additive flowing through the additive conduit to the Venturi pump with the flow meter after said step of actuating;
  - measuring a volume of liquid additive dispensed at the Venturi pump after the flow rate of fluid flowing through the additive conduit to the Venturi pump decreases by at least a predetermined amount during said step of monitoring; and
  - operating the valve to a closed configuration in order to hinder the flow of liquid water to the Venturi pump through the inlet conduit after a predetermined volume of liquid additive has been dispensed at the Venturi pump.

2. The washing machine appliance of claim 1, further comprising a tub and a nozzle, the nozzle positioned at the tub and in fluid communication with the outlet conduit such that the nozzle directs wash fluid from the outlet conduit into the tub.

3. The washing machine appliance of claim 1, wherein the additive conduit extends between an entrance and an exit, the entrance of the additive conduit positioned at the tank, the exit of the additive conduit positioned at the Venturi pump, the entrance of the additive conduit positioned below the exit of the additive conduit along a vertical direction.

4. The washing machine appliance of claim 1, wherein the controller is further configured for gauging the flow rate of liquid additive flowing through the additive conduit to the tank with the flow meter after said step of operating.

5. The washing machine appliance of claim 4, wherein the controller is further configured for determining a height of liquid additive in the tank after said step of gauging.

6. The washing machine appliance of claim 4, wherein the controller is further configured for estimating a volume of liquid additive in the tank after said step of gauging.

7. The washing machine appliance of claim 1, wherein the liquid additive comprises detergent, fabric softener, or bleach.

8. The washing machine appliance of claim 1, wherein the valve comprises a solenoid valve.

9. The washing machine appliance of claim 1, wherein the flow meter comprises a bidirectional flow meter.

10. The washing machine compliance of claim 1, wherein the liquid additive comprises detergent, fabric softener, or bleach, and wherein the flow meter is a bidirectional flow meter.

11. A method for operating a washing machine appliance, comprising:

actuating a valve of the washing machine appliance to an open configuration in order to initiate a flow of liquid water through a Venturi pump of the washing machine appliance, the Venturi pump drawing liquid additive from a tank of the washing machine appliance into the flow of liquid through the Venturi pump after said step of actuating;

monitoring a flow rate of liquid additive from the tank to the Venturi pump with a flow meter of the washing machine appliance after said step of actuating, the flow meter coupled to an additive conduit extending between the tank and the Venturi pump;

measuring a volume of liquid additive dispensed at the Venturi pump after the flow rate of liquid additive flowing from the tank to the Venturi pump substantially decrease during said step of monitoring; and operating the valve to a closed configuration in order to hinder the flow of liquid water to the Venturi pump after a predetermined volume of liquid additive has been dispensed at the Venturi pump.

12. The method of claim 11, further comprising directing a mixed flow of liquid water and liquid additive from the Venturi pump to a nozzle of the washing machine appliance after said step of actuating.

13. The method of claim 11, further comprising gauging a flow rate of liquid additive from the Venturi pump to the tank with the flow meter after said step of operating.

14. The method of claim 13, further comprising determining a height of liquid additive in the tank after said step of gauging based at least in part on the flow rate of liquid additive from the Venturi pump to the tank.

15. The method of claim 13, further comprising estimating a volume of liquid additive in the tank after said step of gauging based at least in part on the flow rate of liquid additive from the Venturi pump to the tank.

16. The method of claim 11, wherein the liquid additive comprises detergent, fabric softener, or bleach.

17. The method of claim 11, wherein staid step of measuring the volume of liquid additive dispensed at the Venturi pump comprises measuring the volume of liquid additive dispensed at the Venturi pump after air has been evacuated from an additive conduit of the washing machine appliance and the flow rate of liquid additive flowing through the additive conduit from the tank to the Venturi pump substantially decreases during said step of monitoring.

18. The method of claim 11, wherein said step of measuring comprises measuring the volume of liquid additive dispensed at the Venturi pump after the flow rate of liquid additive flowing from the tank to the Venturi pump decreases by at least a predetermined amount during said step of monitoring.

19. The method of claim 18, wherein the predetermined amount is selected to permit detection of priming of the Venturi pump.

* * * * *